US010109928B2

(12) United States Patent
You et al.

(10) Patent No.: US 10,109,928 B2
(45) Date of Patent: Oct. 23, 2018

(54) ANTENNA SYSTEM AND WIRELESS DEVICE

(71) Applicant: Wistron NeWeb Corporation, Hsinchu (TW)

(72) Inventors: Shang-Sian You, Hsinchu (TW); Yu Tao, Hsinchu (TW); Tsun-Che Huang, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 184 days.

(21) Appl. No.: 15/132,213

(22) Filed: Apr. 18, 2016

(65) Prior Publication Data

US 2016/0322713 A1 Nov. 3, 2016

Related U.S. Application Data

(60) Provisional application No. 62/154,743, filed on Apr. 30, 2015.

(30) Foreign Application Priority Data

Jan. 29, 2016 (CN) ..... 2016 1 0064706

(51) Int. Cl.

| | |
|---|---|
| ***H01Q 21/00*** | (2006.01) |
| ***H01Q 21/24*** | (2006.01) |
| ***H01Q 1/52*** | (2006.01) |
| ***H01Q 19/10*** | (2006.01) |
| ***H01Q 25/00*** | (2006.01) |
| ***H01Q 5/385*** | (2015.01) |
| ***H01Q 1/24*** | (2006.01) |
| *H01Q 1/22* | (2006.01) |

(52) U.S. Cl.

CPC ..... *H01Q 21/24* (2013.01); *H01Q 1/243* (2013.01); *H01Q 1/521* (2013.01); *H01Q 5/385* (2015.01); *H01Q 19/10* (2013.01); *H01Q 25/00* (2013.01); *H01Q 1/2291* (2013.01)

(58) Field of Classification Search

CPC ..... H01Q 21/24; H01Q 1/521; H01Q 19/10; H01Q 25/00; H01Q 1/243; H01Q 5/385

See application file for complete search history.

(56) References Cited

U.S. PATENT DOCUMENTS

| | | | |
|---|---|---|---|
| 6,646,614 | B2 | 11/2003 | Killen |
| 2004/0217910 | A1 | 11/2004 | Montgomery |

(Continued)

FOREIGN PATENT DOCUMENTS

| | | | |
|---|---|---|---|
| DE | 103 03 540 | A1 | 8/2004 |
| JP | 2003188642 | A | 7/2003 |
| JP | 2008503941 | A | 2/2008 |

*Primary Examiner* — Dieu H Duong

(74) *Attorney, Agent, or Firm* — Winston Hsu

(57) ABSTRACT

An antenna system is disclosed. The antenna system includes a first antenna array coupled to a first radio card, the first antenna array having a plurality of horizontal antennas operating at a first frequency band. A second antenna array is coupled to a second radio card. The second antenna array includes a plurality of dual-band antennas operating at the first frequency band and a second frequency band. The first antenna array and the second antenna array are arranged on a substrate such that a first antenna pattern formed by the first antenna array and a second antenna pattern formed by the second antenna array are mutually orthogonal.

22 Claims, 7 Drawing Sheets

(56) References Cited

U.S. PATENT DOCUMENTS

| | | | | |
|---|---|---|---|---|
| 2005/0057400 | A1 | 3/2005 | Yuanzhu | |
| 2010/0103066 | A1 | 4/2010 | Shtrom | |
| 2010/0119002 | A1 | 5/2010 | Hartenstein | |
| 2010/0309062 | A1 | 12/2010 | Chang | |
| 2010/0315313 | A1* | 12/2010 | Wu | H01Q 1/2291 343/893 |
| 2011/0018780 | A1* | 1/2011 | Tassoudji | H01Q 1/007 343/844 |
| 2012/0139806 | A1 | 6/2012 | Zhan | |
| 2013/0064149 | A1 | 3/2013 | Huang | |
| 2013/0162499 | A1 | 6/2013 | Pochop, Jr. | |
| 2013/0321240 | A1* | 12/2013 | O'Shea | H01Q 21/28 343/893 |
| 2014/0197998 | A1 | 7/2014 | Govindasamy | |

* cited by examiner

ANTENNA SYSTEM AND WIRELESS DEVICE

CROSS REFERENCE TO RELATED APPLICATIONS

This application claims the benefit of U.S. provisional application No. 62/154,743, filed on Apr. 30, 2015 and incorporated herein by reference.

BACKGROUND OF THE INVENTION

1. Field of the Invention

The present invention relates to an antenna system and a wireless device, and more particularly, to an antenna system and a wireless device capable of enhancing isolation between two sets of antennas effectively.

2. Description of the Prior Art

As the wireless communication technology evolves, the demand for wireless networks increases. In the next generation, a standard of IEEE 802.11ac, exploiting multi-user multiple input multiple output (MU-MIMO) technology to enhance transmission rate, is widely adopted by the industry for communication products in wireless local area network (WEAN).

For wireless devices in a WLAN such as wireless routers, wireless base stations, wireless access points, etc., in addition to a plurality of antennas, more than one radio card (usually two radio cards) is required for providing a higher data transmission rate and better quality of service (QoS). That is, a first set of antennas is coupled to a first radio card and a second set of antennas is coupled to a second radio card. However, when all of the antennas operate at a same frequency band, the first set of antennas coupled to the first radio card and the second set of antennas coupled to the second radio card cause mutual interference, which reduces an isolation between the first set of antennas of the first radio card and the second set of antennas of the second radio card, reduces the data transmission rate of the wireless device, and degrades the QoS of the wireless device.

Therefore, how to enhancing isolation between two sets of antennas is a significant objective in the field.

SUMMARY OF THE INVENTION

It is therefore a primary objective of the present invention to provide an antenna system and a wireless device capable of enhancing isolation between two sets of antennas effectively.

An embodiment of the present invention discloses an antenna system disposed on a substrate. The antenna system comprises a first antenna array coupled to a first radio card, the first antenna array comprising a plurality of horizontal antennas parallel to the substrate, operating at a first frequency band; and a second antenna array coupled to a second radio card, the second antenna array comprising a plurality of dual-band antennas, operating at the first frequency band and a second frequency band; wherein the first antenna array and the second antenna array are arranged on the substrate such that a first antenna pattern formed by the first antenna array and a second antenna pattern formed by the second antenna array are mutually orthogonal.

An embodiment of the present invention further discloses a wireless device comprising a first radio card; a second radio card; and an antenna system disposed on a substrate. The antenna system comprises a first antenna array, coupled to the first radio card, the first antenna array comprising a plurality of horizontal antennas, operating at a first frequency band; and a second antenna array, coupled to the second radio card, the second antenna array comprising a plurality of dual-band antennas, operating at the first frequency band and a second frequency band; wherein the first antenna array and the second antenna array are arranged such that a first antenna pattern formed by the first antenna array and a second antenna pattern formed by the second antenna array are mutually orthogonal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
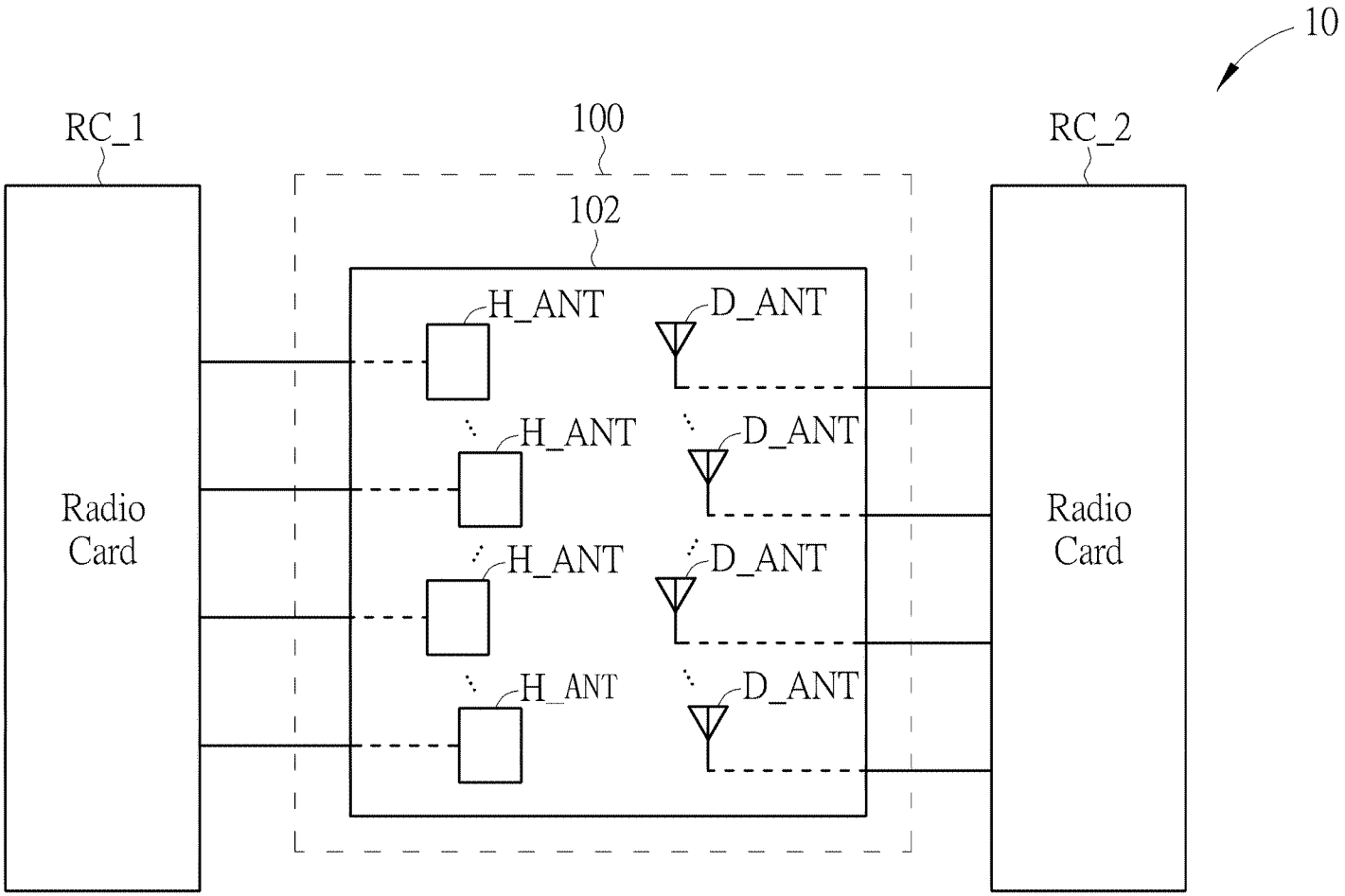
FIG. 1 is a schematic diagram of a wireless device according to an embodiment of the present invention.

FIG. 1 is a schematic diagram of a wireless device 10 according to an embodiment of the present invention. The wireless device 10 may be a wireless router, a wireless base station, a wireless access point, etc. The wireless device 10 comprises an antenna system 100 and radio cards RC_1, RC_2. The antenna system 100 comprises a plurality of horizontal antennas H_ANT and a plurality of dual-band antennas D_ANT. The horizontal antennas H_ANT and the dual-band antennas D_ANT are disposed on a substrate 102. The horizontal antennas H_ANT, parallel to the substrate 102, are arranged as a first antenna array and coupled to the radio card RC_1. The dual-band antennas D_ANT are arranged as a second antenna array and coupled to the radio card RC_2. The first antenna array and the second antenna array may be a specific type of antenna array such as circular arrays or linear arrays. In addition, the horizontal antennas H_ANT of the first antenna array operate at a first frequency band, and the dual-band antennas D_ANT of the second antenna array operate at the first frequency band and a second frequency band. For example, in an embodiment, the horizontal antennas H_ANT operate at a 5 GHz frequency band, and the dual-band antennas D_ANT operate at the 5 GHz frequency band and a 2 GHz frequency band. To reduce mutual interference between the first antenna array and the second antenna array at the first frequency band, a type of antenna array of the first antenna array and the second antenna array in the antenna system 100 may be properly chosen. In addition, positions of the horizontal antennas H_ANT of the first antenna array and the dual-band antennas D_ANT of the second antenna array relative to the substrate 102 may also be properly arranged, such that a first antenna pattern formed by the first antenna array and a second antenna pattern formed by the second antenna array are mutually orthogonal at the first frequency band, and the mutual interference between the first antenna array and the second antenna array at the first frequency band is reduced, so as to enhance an isolation between the first antenna array and the second antenna array.

Figure 2:
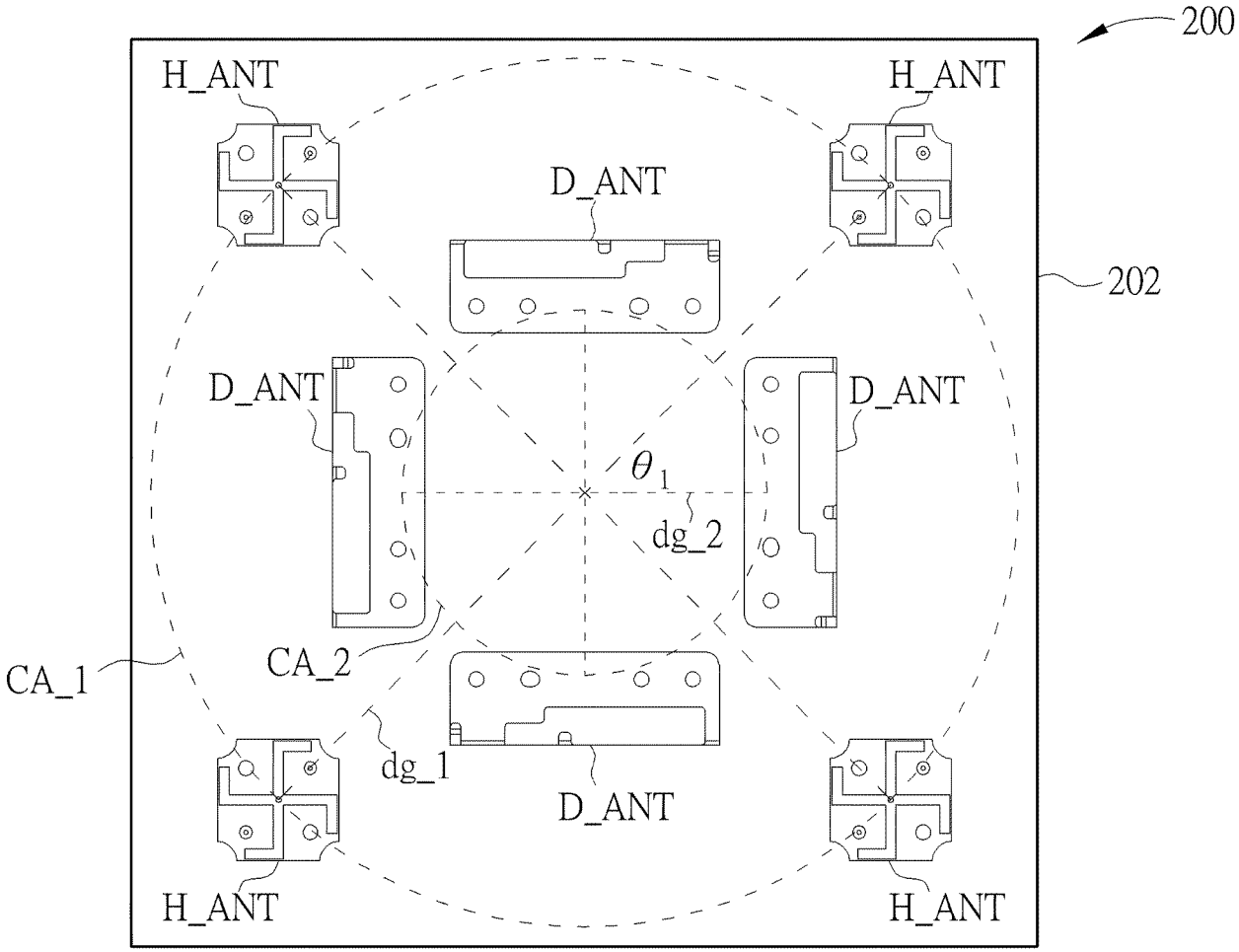
FIG. 2 is a schematic diagram of an antenna system according to an embodiment of the present invention.

For example, FIG. 2 is a schematic diagram of an antenna system 200 according to an embodiment of the present invention. The antenna system 200 comprises four horizontal antennas H_ANT and four dual-band antennas D_ANT disposed on a substrate 202. The horizontal antennas H_ANT and the dual-band antennas D_ANT are arranged as a circular array CA_1 and a circular array CA_2, respectively, on the substrate 202. That is, the circular array CA_1 and the circular array CA_2 represent the first antenna array and the second antenna array, respectively. The antenna system 200 may be applied within the wireless device 10, which means that the circular array CA_1 and the circular array CA_2 are coupled to the radio card RC_1 and the radio card RC_2, respectively, of the wireless device 10. The circular array CA_1 is rotated an angle θ1 related to the circular array CA_2, where the angle θ1 is the angle which makes the first antenna pattern and the second antenna pattern mutually orthogonal. In other words, an inherent diagonal dg_1 of the circular array CA_1 and an inherent diagonal dg_2 of the circular array CA_2 have a included angle as the angle θ1, and the angle θ1 is the angle which makes the first antenna pattern and the second antenna pattern mutually orthogonal. For example, in the antenna system 200, the four horizontal antennas H_ANT are disposed close to four vertices of the substrate 202, and the four dual-band antennas D_ANT are disposed corresponding to four edges of the substrate 202, which means that the angle θ1 between the diagonal dg_1 and the diagonal dg_2 is 45°. Therefore, the first antenna pattern formed by the circular array CA_1 and the second antenna pattern formed by the circular array CA_2 are mutually orthogonal at the first frequency band, and the mutual interference between the circular array CA_1 and the circular array CA_2 at the first frequency band is reduced, so as to enhance the isolation between the circular array CA_1 and the circular array CA_2.

In addition, to further enhance the isolation between the first antenna array and the second antenna array, structures of the dual-band antennas D_ANT in the antenna system 200 may be properly designed for utilizing different polarization directions of the antennas. Specifically, given that the horizontal antennas H_ANT are horizontally polarized antenna operating at the first frequency band, the dual-band antennas D_ANT may comprise a vertical radiating element and a horizontal radiating element. The vertical radiating element is a vertically polarized radiating element, and the horizontal radiating element a horizontal polarized radiating element. The vertical radiating element operates at the first frequency band, and the horizontal radiating element operates at the second frequency band. Notably, in the first frequency band, a polarization direction of the horizontal antennas H_ANT and a polarization direction of the vertical radiating element in the dual-band antennas D_ANT are orthogonal to each other, which further enhances the isolation between the horizontal antennas H_ANT of the first antenna array and the dual-band antennas D_ANT of the second antenna array. In the antenna system 200, the isolation between the first antenna array and the second antenna array may achieve 40 dB.

Figure 3A:
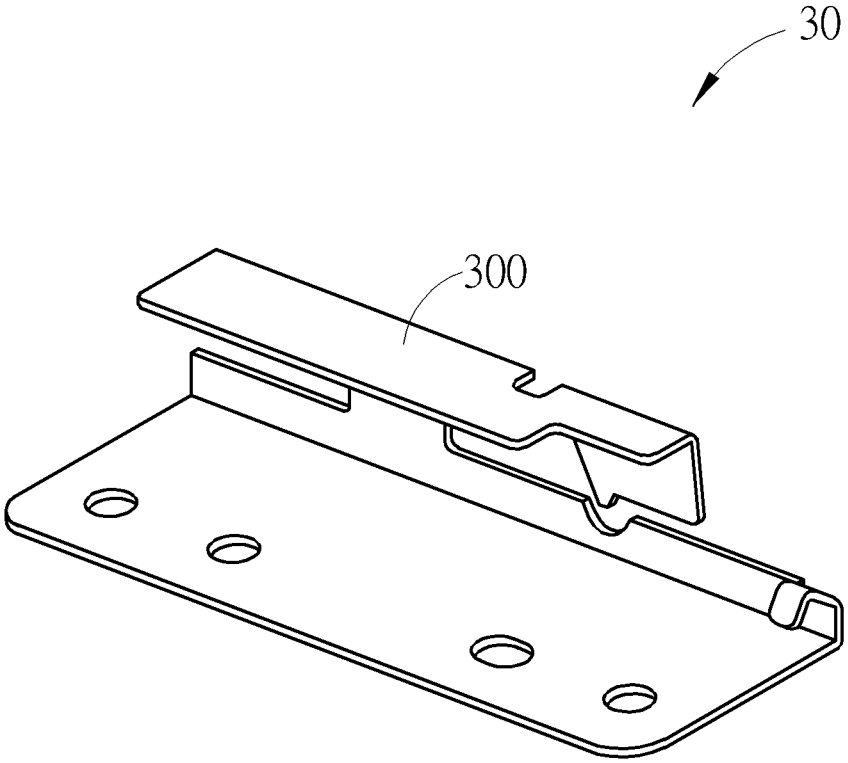
FIG. 3A is a schematic diagram of an isometric view of a dual-band antenna in FIG. 2.
Figure 3B:
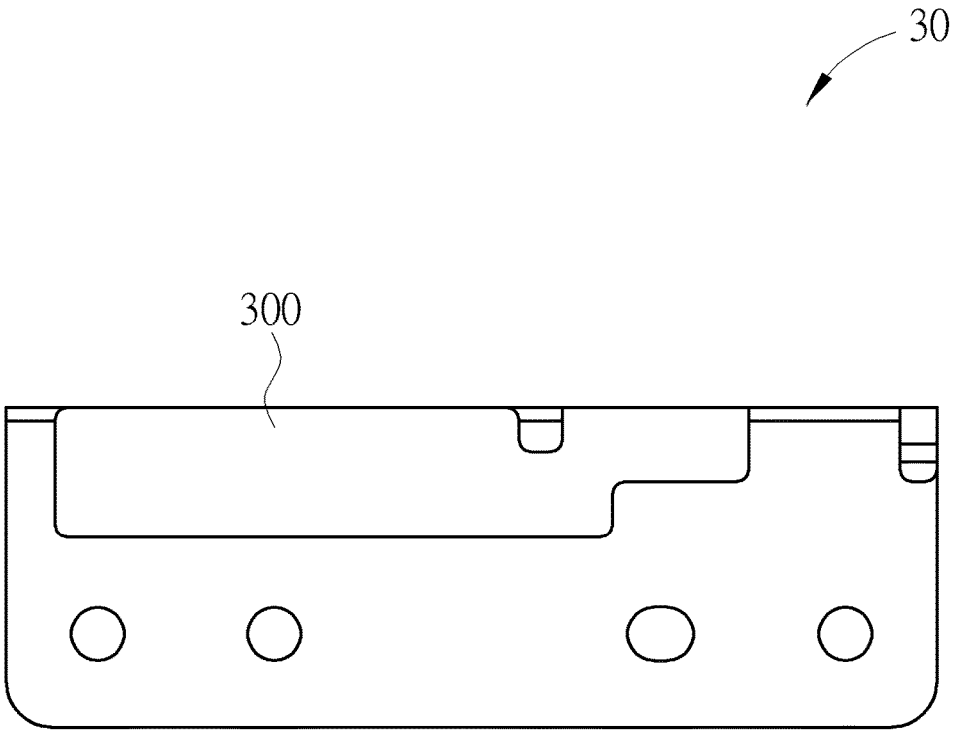
FIG. 3B is a schematic diagram of a top view of the dual-band antenna in FIG. 2.
Figure 3C:
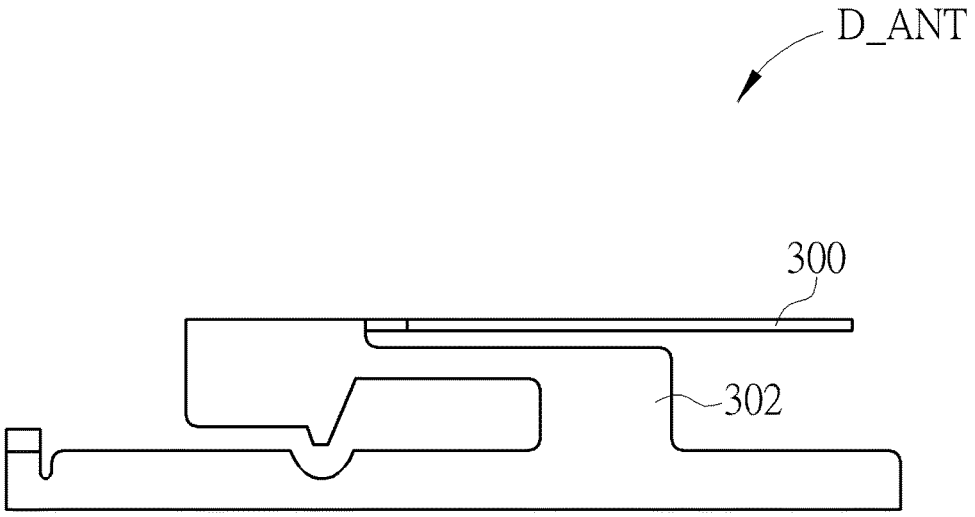
FIG. 3C is a schematic diagram of a side view of the dual-band antenna in FIG. 2.

The structure of the dual-band antenna D_ANT is not limited. For example, FIGS. 3A-3C are schematic diagrams of an isometric view, a top view, and a side view, respectively, of a dual-band antenna 30. The dual-band antenna 30 is utilized to realize the dual-band antennas D_ANT in the antenna system 200. As shown in FIGS. 3A-3C, the dual-band antenna 30 comprises a horizontal radiating element 300 and a vertical radiating element 302. The vertical radiating element 302, mainly operating at the first frequency band, is perpendicular to the substrate 202. The horizontal radiating element 300, mainly operating at the second frequency band, is parallel to the substrate 202. Notably, the dual-band antennas D_ANT are not limited to the structure of the dual-band antenna 30 and other structures may be utilized to implement the dual-band antennas D_ANT. As long as the first antenna array and the second antenna array are arranged in a specific arrangement to enhance the isolation in between, the requirement of the present invention is satisfied.

Figure 4:
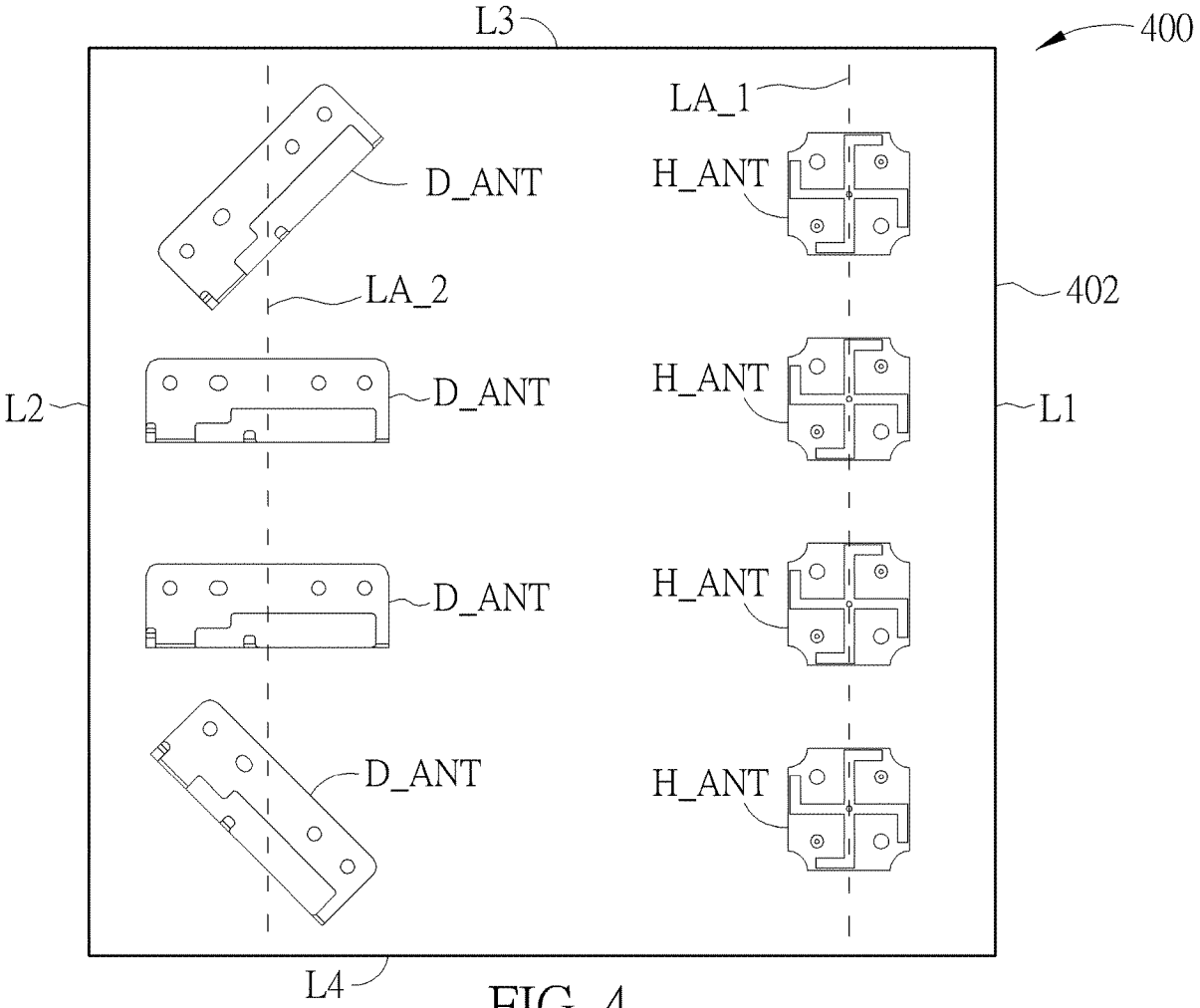
FIG. 4 is a schematic diagram of an antenna system according to an embodiment of the present invention.

In addition, the horizontal antennas H_ANT and the dual-band antennas D_ANT are not limited to be arranged as circular arrays. The horizontal antennas H_ANT and the dual-band antennas D_ANT may also be arranged as linear arrays. For example, FIG. 4 is a schematic diagram of an antenna system 400 according to an embodiment of the present invention. The antenna system 400 comprises four horizontal antennas H_ANT and four dual-band antennas D_ANT, disposed on a substrate 402. The substrate 402 is annotated with a first edge L1, a second edge L2, a third edge L3 and a fourth edge L4. The horizontal antennas H_ANT and the dual-band antennas D_ANT are arranged as a straight linear array LA_1 and a straight linear array LA_2, respectively, on the substrate 402. That is, the horizontal antennas H_ANT are arranged as a straight line on the substrate 402, so are the dual-band antennas D_ANT. The straight linear array LA_1 and the straight linear array LA_2 represent the first antenna array and the second antenna array, respectively, of the antenna system 400. The straight linear array LA_1 is disposed near the first edge L1 of the substrate 402, and the straight linear array LA_2 is disposed near the second edge L2, opposite to the first edge L1, of the substrate 402. The antenna system 400 may be applied within the wireless device 10, which means that the straight linear array LA_1 and the straight linear array LA_2 are coupled to the radio card RC_1 and the radio card RC_2, respectively, of the wireless device 10. To achieve better isolation, the dual-band antenna D_ANT which is closest to the third edge L3 in the antenna system 400 is counter-clockwise rotated a first angle, and the dual-band antenna D_ANT which is closest to the fourth edge L4 in the antenna system 400 is clockwise rotated a second angle. The first angle and the second angle may be 30-60 degrees. In some embodiments, the first angle and the second angle can be 45 degrees. Therefore, the isolation between the first antenna array and the second antenna array in the antenna system 400 is able to achieve 40 dB.

Figure 5:
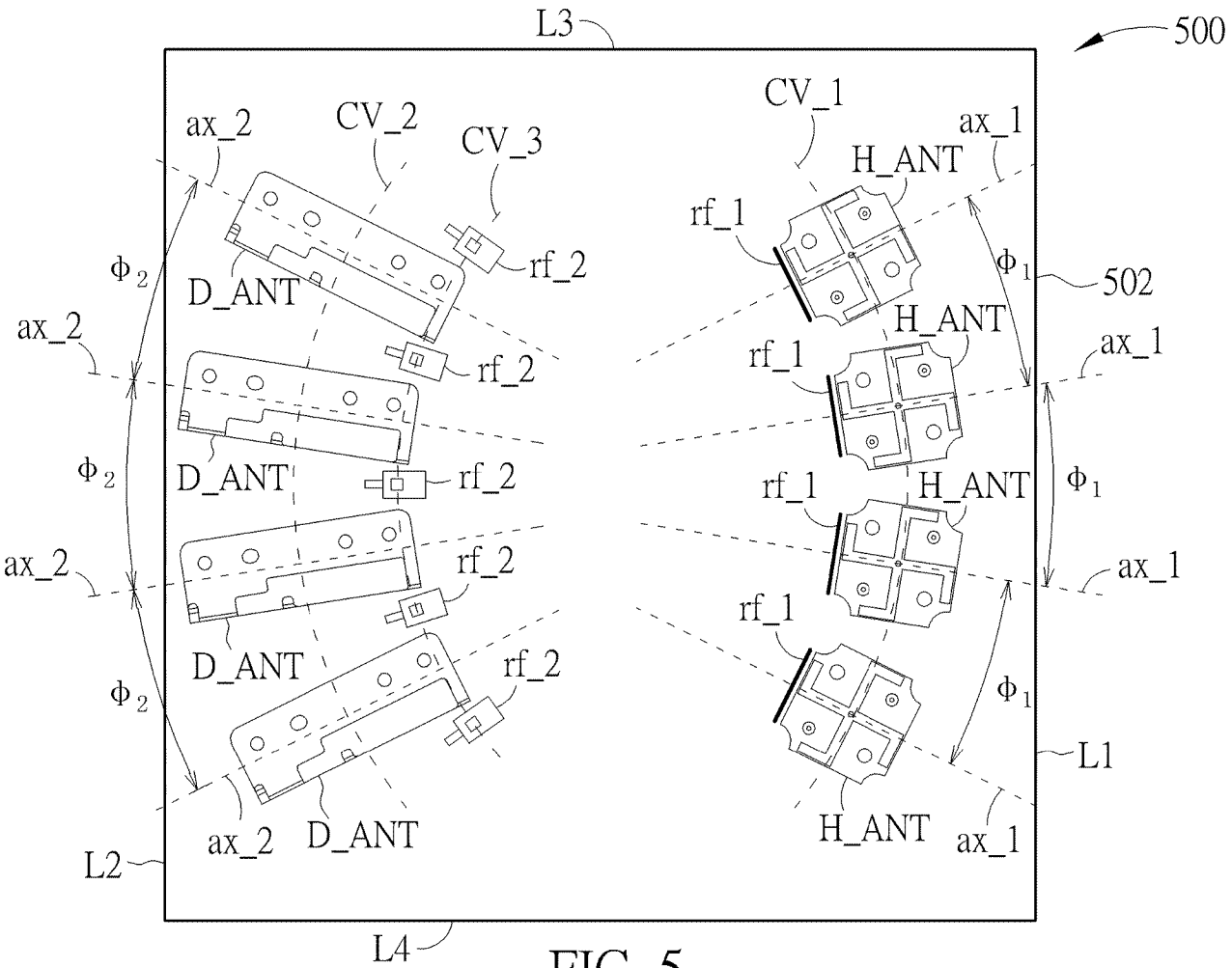
FIG. 5 is a schematic diagram of an antenna system according to an embodiment of the present invention.

In addition, the horizontal antennas H_ANT and the dual-band antennas D_ANT are not limited to be arranged as straight linear arrays. The horizontal antennas H_ANT and the dual-band antennas D_ANT may also be arranged as curved linear arrays. For example, FIG. 5 is a schematic diagram of an antenna system 500 according to an embodiment of the present invention. Similar to the antenna system 400, the antenna system 500 comprises four horizontal antennas H_ANT and four dual-band antennas D_ANT, disposed on a substrate 502. The substrate 502 of the antenna system 500 are also annotated with the first edge L1, the second edge L2, the third edge L3 and the fourth edge L4. The first antenna array formed by the horizontal antennas H_ANT is disposed near the first edge L1 of the substrate 502, and the second antenna array formed by the dual-band antennas D_ANT is disposed near the second edge L2 of the substrate 502. Different from the antenna system 400, in the antenna system 500, the horizontal antennas H_ANT and the dual-band antennas D_ANT are arranged as a curved linear array CV_1 and a curved linear array CV_2, respectively, on the substrate 502. That is, the horizontal antennas H_ANT are arranged as a curved line on the substrate 502, so are the dual-band antennas D_ANT. In other words, a central axis ax_1 of one horizontal antenna H_ANT and a central axis ax_1 of adjacent horizontal antenna(s) H_ANT have a first included angle φ1, and a central axis ax_2 of one dual-band antenna D_ANT and a central axis ax_2 of adjacent dual-band antenna (s) D_ANT have a second included angle φ2. The curved linear array CV_1 and the curved linear array CV_2 represent the first antenna array and the second antenna array, respectively, of the antenna system 500. The antenna system 500 may be applied within the wireless device 10, which means that the curved linear array CV_1 and the curved linear array CV_2 are coupled to the radio card RC_1 and the radio card RC_2, respectively, of the wireless device 10. In addition, the antenna system 500 further comprises a plurality of first reflectors rf_1 and a plurality of second reflectors rf_2. Each of the first reflectors rf_1 is corresponding to and adjacent to one horizontal antenna H_ANT. On the other hand, the plurality of second reflectors rf_2 are arranged as a curved linear array CV_3, i.e., the second reflectors rf_2 are arranged as a curved line as well. The curved linear array CV_3 is in an interior of the substrate 502 related to the curved linear array CV_2, which means that the curved linear array CV_3 is disposed between the curved linear array CV_1 and the curved linear array CV_2. In general, the second reflectors rf_2 are disposed near two edges of each of the dual-band antennas D_ANT of the antenna system 500, such that an antenna pattern formed by the dual-band antennas D_ANT is a directional pattern. Moreover, the second reflectors rf_2 near the third edge L3 and the fourth edge L4 of the substrate 502 are utilized for suppressing effect brought by side lobes. In addition, the first reflectors rf_1 and the second reflectors rf_2 may be coupled to a switching circuit (not illustrated in FIG. 5). When the switching circuit is switched to a first status, the first antenna pattern formed by the first antenna array and the second antenna pattern formed by the second antenna array are omni-directional. On the other hand, when the switching circuit is switched to a second status, the first antenna pattern formed by the first antenna array and the second antenna pattern formed by the second antenna array are directional. In such a situation, the isolation between the first antenna array and the second antenna array in the antenna system 500 is able to achieve 50 dB. In addition, the first reflectors rf_1 or the second reflectors rf_2 may be simply passive component without connecting to any switching circuit.

In the prior art, when the radio cards of the wireless device operate at the same frequency band, the antennas of the radio cards cause interference towards each other, which degrades transmission efficiency of the wireless device. In comparison, the present invention arranges the antennas on the substrate at the proper positions and utilizes the proper structure of the dual-band antennas and different polarization directions, so as to enhance the isolation between the antenna arrays coupled to the different radio cards, reduce mutual interference of the antenna arrays, and enhance the transmission efficiency of the wireless device.

Notably, the embodiments stated in the above are utilized for illustrating the concept of the present invention. Those skilled in the art may make modifications and alternations accordingly, and not limited herein. For example, in the antenna system 200, the circular array CA_2 is disposed in an inside of the circular array CA_1, which is not limited thereto. The circular array CA_1 may also be disposed in an inside of the circular array CA_2. In addition, the antenna system 400 and the antenna system 500 only comprise the four horizontal antennas H_ANT and the four dual-band antennas D_ANT, which is not limited thereto. The antenna system may comprise more (or less) than four horizontal antennas H_ANT and more (or less) than four dual-band antennas D_ANT, which is within the scope of the present invention.

In summary, the present invention arranges the antennas on the substrate at the proper positions and utilizes the proper structure of the dual-band antennas and different polarization directions, so as to enhance the isolation between the antenna arrays coupled to the different radio cards, reduce mutual interference of the antenna arrays, and enhance the transmission efficiency of the wireless device.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna system, disposed on a substrate, the antenna system comprising:

a first antenna array coupled to a first radio card, the first antenna array comprising a plurality of horizontal antennas operating at a first frequency band; and a second antenna array coupled to a second radio card, the second antenna array comprising a plurality of dual-band antennas operating at the first frequency band and a second frequency band, wherein each dual-band antenna comprises a vertical radiating element operating at the first frequency band and a horizontal radiating element operating at the second frequency band;

wherein the first antenna array and the second antenna array are arranged on the substrate such that a first antenna pattern formed by the first antenna array and a second antenna pattern formed by the second antenna array are mutually orthogonal.

2. The antenna system of claim 1, wherein the first antenna array and the second antenna array are arranged as a first circular array and a second circular array, respectively, an angle is between a first diagonal of the first antenna array and a second diagonal of the second antenna array, and the angle is set such that the first antenna pattern and the second antenna pattern are mutually orthogonal.

3. The antenna system of claim 2, wherein the plurality of horizontal antennas is disposed adjacent to four vertexes of the substrate, and the plurality of dual-band antennas is disposed corresponding to four edges of the substrate.

4. The antenna system of claim 2, wherein the angle is a multiple of 45 degrees.

5. The antenna system of claim 1, wherein the first antenna array and the second antenna array are arranged as linear arrays, the first antenna array is disposed adjacent to a first edge of the substrate, and the second antenna array is disposed adjacent to a second edge of the substrate, and the second edge is opposite to the first edge.

6. The antenna system of claim 5, wherein the first antenna array and the second antenna array are arranged as a first straight linear array and a second straight linear array, respectively, a first dual-band antenna of the second antenna array is rotated by a first angle, and a second dual-band antenna of the second antenna array is rotated by a second angle.

7. The antenna system of claim 5, wherein the first antenna array and the second antenna array are arranged as a first curved linear array and a second curved linear array, respectively.

8. The antenna system of claim 7, wherein a first included angle is between a first central axis of a first horizontal antenna and a second central axis of a second horizontal antenna adjacent to the first horizontal antenna within the first antenna array, and a second included angle is between a third central axis of a first dual-band antenna and a fourth central axis of a second dual-band antenna adjacent to the first dual-band antenna within the second antenna array.

9. The antenna system of claim 7, further comprising a plurality of first reflectors, wherein a first reflector within the plurality of first reflectors is corresponding to and adjacent to a horizontal antenna within the plurality of horizontal antennas.

10. The antenna system of claim 9, further comprising a plurality of second reflectors, wherein the plurality of second reflectors is arranged as a third curved linear array, the third curved linear array is disposed in an interior of the substrate related to the second curved linear array, and the plurality of second reflectors is disposed adjacent to two sides of each dual-band antenna of the plurality of dual-band antennas.

11. The antenna system of claim 10, wherein the plurality of second reflectors is connected to a switching circuit, the switching circuit is configured to control the second antenna pattern to be omni-directional or directional.

12. A wireless device, comprising:

a first radio card;

a second radio card; and an antenna system, disposed on a substrate, the antenna system comprising:

a first antenna array coupled to the first radio card, the first antenna array comprising a plurality of horizontal antennas operating at a first frequency band; and a second antenna array coupled to the second radio card, the second antenna array comprising a plurality of dual-band antennas operating at the first frequency band and a second frequency band, wherein each dual-band antenna comprises a vertical radiating element operating at the first frequency band and a horizontal radiating element operating at the second frequency band;

wherein the first antenna array and the second antenna array are arranged such that a first antenna pattern formed by the first antenna array and a second antenna pattern formed by the second antenna array are mutually orthogonal.

13. The wireless device of claim 12, wherein the first antenna array and the second antenna array are arranged as a first circular array and a second circular array, respectively, an angle is between a first diagonal of the first antenna array and a second diagonal of the second antenna array, and the angle is set such that the first antenna pattern and the second antenna pattern are mutually orthogonal.

14. The wireless device of claim 13, wherein the plurality of horizontal antennas is disposed adjacent to four vertexes of the substrate, and the plurality of dual-band antennas is disposed corresponding to four edges of the substrate.

15. The wireless device of claim 13, wherein the angle is a multiple of 45 degrees.

16. The wireless device of claim 12, wherein the first antenna array and the second antenna array are arranged as linear arrays, the first antenna array is disposed adjacent to a first edge of the substrate, and the second antenna array is disposed adjacent to a second edge of the substrate, and the second edge is opposite to the first edge.

17. The wireless device of claim 16, wherein the first antenna array and the second antenna array are arranged as a first straight linear array and a second straight linear array, respectively, a first dual-band antenna of the second antenna array is rotated by a first angle, and a second dual-band antenna of the second antenna array is rotated by a second angle.

18. The wireless device of claim 16, wherein the first antenna array and the second antenna array are arranged as a first curved linear array and a second curved linear array, respectively.

19. The wireless device of claim 18, a first included angle is between a first central axis of a first horizontal antenna and a second central axis of a second horizontal antenna adjacent to the first horizontal antenna within the first antenna array, and a second included angle is between a third central axis of a first dual-band antenna and a fourth central axis of a second dual-band antenna adjacent to the first dual-band antenna within the second antenna array.

20. The wireless device of claim 18, further comprising a plurality of first reflectors, wherein a first reflector within the plurality of first reflectors is corresponding to and adjacent to a horizontal antenna within the plurality of horizontal antennas.

21. The wireless device of claim 20, further comprising a plurality of second reflectors, wherein the plurality of second reflectors is arranged as a third curved linear array, the third curved linear array is disposed in an interior of the substrate related to the second curved linear array, and the plurality of second reflectors is disposed adjacent to two sides of each dual-band antenna of the plurality of dual-band antennas.

22. The wireless device of claim 21, wherein the plurality of second reflectors is connected to a switching circuit, the switching circuit is configured to control the second antenna pattern to be omni-directional or directional.

* * * * *